US010501829B2

(12) United States Patent
Bohner et al.

(10) Patent No.: US 10,501,829 B2
(45) Date of Patent: Dec. 10, 2019

(54) METHOD FOR PRODUCING A STRUCTURAL SHEET METAL COMPONENT, AND A STRUCTURAL SHEET METAL COMPONENT

(75) Inventors: Friedrich Bohner, Oerlinghausen (DE); Jochen Dörr, Bad Driburg (DE); Jochem Grewe, Salzkotten (DE)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 1347 days.

(21) Appl. No.: 13/455,762

(22) Filed: Apr. 25, 2012

(65) Prior Publication Data

US 2012/0273098 A1 Nov. 1, 2012

(30) Foreign Application Priority Data

Apr. 26, 2011 (DE) ..... 10 2011 002 267

(51) Int. Cl.

| | |
|---|---|
| ***C22F 1/053*** | (2006.01) |
| ***C22C 21/18*** | (2006.01) |
| ***C22C 21/06*** | (2006.01) |
| ***C22C 21/10*** | (2006.01) |
| ***C22F 1/047*** | (2006.01) |
| ***C21D 1/673*** | (2006.01) |
| ***C22F 1/057*** | (2006.01) |

(52) U.S. Cl.

CPC ..... *C22C 21/18* (2013.01); *C21D 1/673* (2013.01); *C22C 21/06* (2013.01); *C22C 21/10* (2013.01); *C22F 1/047* (2013.01); *C22F 1/053* (2013.01); *C22F 1/057* (2013.01)

(58) Field of Classification Search

CPC ..... C22F 1/053; C22F 1/05; C22F 1/057

See application file for complete search history.

(56) References Cited

U.S. PATENT DOCUMENTS

| | | | | |
|---|---|---|---|---|
| 4,090,889 | A † | 5/1978 | George | |
| 5,771,962 | A | 6/1998 | Evans et al. | |
| 5,948,185 | A * | 9/1999 | Krajewski ..... | B21D 39/02 148/415 |

(Continued)

FOREIGN PATENT DOCUMENTS

| | | |
|---|---|---|
| DE | 197 13 356 | 11/1997 |
| DE | 201 18 511 | 3/2002 |

(Continued)

OTHER PUBLICATIONS

Heat Treating of Aluminum Alloys, Heat Treating, vol. 4, ASM Handbook, ASM International, 1991, p. 841-879.*

(Continued)

*Primary Examiner* — George Wyszomierski
*Assistant Examiner* — Janell C Morillo
(74) *Attorney, Agent, or Firm* — Henry M. Feiereisen LLC

(57) ABSTRACT

A method for producing a structural sheet metal component formed from an aluminum alloy for a motor vehicle includes providing an aluminum sheet blank in a state T4 or T5 or T6 or T7, heating the aluminum sheet blank to a heating temperature between 100° C. and 450° C., forming the aluminum sheet blank to a structural sheet metal component, and heat post-treatment of the formed structural sheet metal component.

20 Claims, 5 Drawing Sheets

(56) References Cited

U.S. PATENT DOCUMENTS

| | | | |
|---|---|---|---|
| 6,033,499 | A † | 3/2000 | Mitra |
| 6,406,571 | B1 † | 6/2002 | Gupta |
| 6,550,302 | B1 † | 4/2003 | Ghosh |
| 6,685,782 | B1 † | 2/2004 | Schwellinger |
| 7,278,287 | B2 | 10/2007 | Bohner et al. |
| 8,020,907 | B2 | 9/2011 | Wibbeke et al. |
| 2006/0230806 | A1 | 10/2006 | Bohner et al. |
| 2007/0044939 | A1 | 3/2007 | Hummel et al. |
| 2010/0064759 | A1 | 3/2010 | Kondo et al. |
| 2010/0194125 | A1 | 8/2010 | Wibbeke et al. |
| 2012/0186706 | A1 † | 7/2012 | Krajewski |

FOREIGN PATENT DOCUMENTS

| | | | |
|---|---|---|---|
| DE | 202006016339 | | 2/2007 |
| DE | 102006032406 | | 1/2008 |
| DE | 112006002196 | | 9/2008 |
| DE | 102009012509 | | 9/2010 |
| EP | 0805879 | B1 † | 1/2001 |
| EP | 2 415 882 | | 2/2012 |
| JP | 2006-205244 | | 8/2006 |
| WO | WO 02/075010 | | 9/2002 |
| WO | WO 2004/076092 | | 9/2004 |
| WO | WO2010/032002 | † | 3/2010 |
| WO | WO2011/058332 | † | 5/2011 |

OTHER PUBLICATIONS

R.B.C Cayless, Alloy and Temper Designations Systems for Aluminum and Aluminum Alloys, Properties and Selection: Nonferrous Alloys and Special Purpose Materials, vol. 2, ASM Handbook, ASM International, 1990, p. 15-28.*

DE 197 13 356 corresponds to U.S. Pat. No. 5,771,962, of which a copy is enclosed for translation purposes only.

DE 11 2006 002 196 corresponds to US 2007/0044939, of which a copy is enclosed for translation purposes only.

An automatic Google translation of DE 201 18 511 is enclosed.

European Search Report issued by the European Patent Office dated Sep. 12, 2012 in counterpart European Application No. EP 12 15 6533.

English translation of European Search Report issued by the European Patent Office dated Sep. 12, 2012 in counterpart European Application No. EP 12 15 6533.

Dr. Herve Ribes et al. "Aluminum in Car Body: from incremental improvements to jointly developed innovation." Alcan, Material in Car Body Engineering, pp. 1-18, May 18-19, 2010.†

Dr. Chrise Lahaye "New high strength 7xxx and high formable 6xxx alloys for structural applications in BIW and body panels," Aleris Europe, pp. 1-28, Mar. 22, 2011.†

Alistair D. Foster et al. "An Investigation of Lubrication and Heat Transfer for a Sheet Aluminum Heat, Form-Quench (HFQ) Process." University of Birmingham, Special Edition Metal Forming Conference 2008, vol. 2, pp. 113-119.†

J. Lin et al. "An Investigation of the effects of solution heat treatment on mechanical properties for AA 6xxx alloys: experimentation and modeling." University of Birmingham, International Journal of Plasticity 21, pp. 1640-1657, available online Dec. 19, 2004.†

Mohamed et al. "Solution Heat Treatment in HFQ Process." Imperial College London. Special Edition Metal Forming Conference 2008, vol. 2, pp. 160-167.†

M.S. Mohamed el al. "Hybrid forming processes for the production of lightweight high-strength automotive panel parts." Imperial College London, Plenary Lecture at ICTPMCS-2010, pp. 1-8, Shanghai China.†

Materials World Magazine, "Advances in Aluminum for Automobiles." By Ian Salusbury. Jul. 2, 2010.†

"7xxx-high strength aluminum sheets for lightweight automotive applications." Automotive AluReport Mar. 2012.†

* cited by examiner
† cited by third party

METHOD FOR PRODUCING A STRUCTURAL SHEET METAL COMPONENT, AND A STRUCTURAL SHEET METAL COMPONENT

CROSS-REFERENCES TO RELATED APPLICATIONS

This application claims the priority of German Patent Application, Serial No. 10 2011 002 267.8, filed Apr. 26, 2011, pursuant to 35 U.S.C. 119(a)-(d), the content of which is incorporated herein by reference in its entirety as if fully set forth herein.

BACKGROUND OF THE INVENTION

The present invention relates to a method for producing a structural sheet metal component for a motor vehicle. The present invention also relates to a structural sheet metal component for a motor vehicle.

The following discussion of related art is provided to assist the reader in understanding the advantages of the invention, and is not to be construed as an admission that this related art is prior art to this invention.

Various forming techniques for producing structural sheet metal components are known in the art. The attainable forming limits are hereby defined by the forming process and the employed material and can be expanded by corresponding heat treatment processes.

For this purpose, heat pre-treatment processes, intermediate heat treatment processes as well as heat post-treatment processes are known, with which on one hand the forming characteristic of the employed material can be expanded, and, on the other hand, the mechanical properties can be specifically reestablished or adjusted after the forming operation. The structural sheet metal components can be produced with particular ease when they are formed directly after solution annealing of the initial state of the aluminum alloy or at a temperature of at least 400° C.

However, the excellent forming characteristic is associated with correspondingly diminished mechanical strength values of the component after forming.

In particular in the construction of the body of motor vehicles, substantial design flexibility in their shape is desired, so that complex formed components representing at least a component of a self-supporting motor vehicle body can be created commensurate with the function or the design requirement. In addition, a large portion of the self-supporting motor vehicle body forms the passenger safety compartment, which in turn requires a high strength in the event of a potential vehicle crash.

It would therefore be desirable and advantageous to obviate prior art shortcomings and to provide an improved method for producing structural sheet metal components made of an aluminum alloy having substantial design flexibility in their shape, without significant deterioration of the strength parameters of the produced structural sheet metal component. It is also an object of the present invention to provide a corresponding structural sheet metal component.

SUMMARY OF THE INVENTION

According to one aspect of the present invention, a method for producing a structural sheet metal component made from an aluminum alloy for a motor vehicle includes providing an aluminum sheet blank in a state T4 or T5 or T6 or T7, heating the aluminum sheet blank to a heating temperature between 100° C. and 450° C., forming the aluminum sheet blank to a structural sheet metal component, and heat post-treatment of the formed structural sheet metal component.

According to an advantageous feature of the present invention, the structural sheet metal component may be formed of a precipitation-hardenable aluminum alloy Forming may initially take place directly after heating to the heating temperature. However, the sheet metal blank may also be heated in the tool itself and formed directly. Alternatively, the aluminum sheet metal blank is after being heated to the heating temperature first cooled down in air or quenched with a medium, and is subsequently cold-formed in a tool.

The designation T4, T5, T6 or T7 refers to heat-treated states of an aluminum alloy according to DIN EN 515. The state T4 hereby indicates that the aluminum sheet metal blank is solution-annealed and naturally aged. The state 15 indicates that the aluminum sheet metal blank is quenched from the hot-forming temperature and tempered. T6 indicates that the sheet metal blank is solution-annealed and tempered, and T7 indicates that the sheet metal blank is solution-annealed and over-aged.

The method according to the invention allows the production of parts with a complex shape, which could not be produced without heating the blank, because an increase in the temperature significantly improves the forming characteristic of hardenable wrought aluminum alloys. The mechanical properties, in particular the strength characteristics at the end of the method according to the invention, are approximately equal to the mechanical strength characteristics of the aluminum sheet metal blanks in their initial state. According to an advantageous feature of the present invention, the heat post-treatment of the formed structural sheet metal component does not include a solution-annealing treatment, i.e. no heat post-treatment above 450° C., which in turn additionally saves energy and time in the production of a structural sheet metal component according to the invention. According to another advantageous feature of the present invention, distortion of the component is prevented or the use of an additional holding device becomes unnecessary by eliminating a solution annealing treatment with subsequent quenching.

According to an advantageous feature of the present invention, heating to the heating temperature may be performed in less than 60 minutes, preferably in less than 30 minutes, and in particular preferred embodiment in less than 10 minutes, so that very short cycle times in the production of the structural sheet metal components according to the invention can be selected. In addition, considerable energy savings are achieved with the very short heat pre-treatment. This makes the entire production process significantly more cost-effective.

At least with the alloys in the state T4, heating is advantageously performed to more than 250° C., and with the alloys in the state T6 to more than 300° C.; comparison experiments have demonstrated that mechanical parameters for these alloys comparable with the initial state could otherwise not be obtained.

According to an advantageous feature of the present invention, heating may be performed resistively, convectively, conductively and/or inductively and/or with heat radiation and/or with heat conduction. For example, heating may be performed in an oven with a combination of convection and heat radiation. Inductive heating can be performed with induction heat generators. For example, partial heating may be performed with inductive heating or completely in an oven, depending on the requirement. The heating method in turn depends on the size of the employed sheet metal blank.

According to an advantageous feature of the present invention, heating may be performed for less than 10 minutes, in particular for less than 1 minute and in a particularly preferred embodiment within less than 15 seconds. However, heating may at least be performed for a fraction of a second, for example in 0.1 seconds, in particular in 0.5 seconds, and most particular in 1 second or less. According to another advantageous feature of the present invention, a holding time of the temperature may follow after the heating time. Advantageously, the component may be held at the heating temperature for less than 5 minutes, in particular for less than 3 minutes, before being transferred to the forming tool. With heating being performed relatively slowly over about 5 to 10 minutes, a holding time before transfer to the forming tool may be completely eliminated. Advantageously, this type of heating may be performed in a continuous oven, wherein a substitution for holding already occurs during passage through the continuous oven due to the slow heating.

According to another advantageous feature of the present invention, heating may also be performed by thermal radiation, for example with infrared heating or heating with a heat jet, for example by a hot air blower or a microwave heating. Within the context of the invention, heating by heat conduction would also be feasible, whereby heating may be performed by heat conduction through direct contact with a hot plate or with a heater, for example in a forming tool or in a pre-heating tool.

According to an advantageous feature of the present invention, the aluminum sheet metal blank may be formed without active cooling after heating. The heating temperature is hereby only marginally reduced through cooling in air during the intermediate transfer from the heating station to the forming tool. The heat loss is hereby preferably less than 50° C., in particular less than 40° C. and particularly preferred less than 30° C. Eliminating the cooling process again saves energy and production time.

According to yet another advantageous feature of the present invention, the aluminum sheet metal blank, after being heated to the heating temperature, may be passively cooled by the ambient air at room temperature and/or the heated aluminum sheet metal blank may be actively cooled, wherein active cooling may advantageously be performed through contact with a medium and forming is performed after cooling. Forming in the forming tool itself may, for example, be performed as cold-forming. Advantageously, forming may take place at a component temperature of less than 150° C., in particular less of than 120° C. and in a particularly preferred embodiment of less than 100° C. Alternatively or in addition, quenching may be performed exclusively or additionally by blowing with gas, in particular air.

According to an advantageous feature of the present invention, active cooling may performed by quenching, preferably by quenching in and/or with water. Within the context of the invention, the heated aluminum sheet metal blank may be fully immersed in a cooling basin or wetted and/or sprayed with water. Quenching generally refers to direct contact with the water or with an aqueous solution.

Rapid cooling may be necessary with aluminum alloys having an increased copper fraction to ensure that the (partially) oversaturated structure of the preceding heat treatment is frozen. Advantageously, cooling speeds may be set to more than 100° C./s, preferably to more than 250° C./s, and in a particularly preferred embodiment to more than 400° C./s.

According to an advantageous feature of the present invention, the heat treatment of the formed structural sheet metal component may be performed as precipitation hardening. Precipitation hardening is a heat treatment for increasing the hardness and strength of alloys. The method is based on precipitating metastable phases in finely distributed form, so that these phases form an effective barrier against the movement of dislocations. The yield strength of metals can hereby be significantly increased. Precipitation hardening represents the most important approach for increasing the strength of hardenable aluminum alloys, because aluminum alloys cannot be hardened through the formation of martensite.

Precipitation hardening within the context of the invention refers to natural aging or tempering or a combination of natural aging and tempering. In the course of experiments, the applicant observed the surprising result that the initial strength can be obtained by entirely eliminating solution annealing through specific control of the aging processes according to the characterizing part of the method claim, without a significant deterioration of the mechanical properties compared to normal process of precipitation hardening.

Natural aging with aluminum alloys may be performed, for example, by subsequent quenching following a heat treatment. Quenching suppresses the typical precipitation of alloy elements during slow cooling. The alloy elements are in an oversaturated environment.

Quenching may be followed by natural aging, preferably at room temperature. The process is based on the fact that the aluminum lattice attempts to precipitate the alloy element in solution. This produces zones rich of the alloy element, which more strongly block the slip plane of the structure. Natural aging is normally terminated only after several weeks or even months. By increasing the temperature above room temperature, preferably 30° C. to 40° C., in particular 35° C., this process may be accelerated, whereby cooling below room temperature delays natural aging.

According to an advantageous feature of the present invention, natural aging may be performed after forming and quenching preferably at room temperature for less than 251 hrs, and a heat treatment is performed at 70° C. to 120° C. for 5 to 15 hours.

According to another advantageous feature of the present invention, the combination of natural aging and tempering may be performed in multiple steps; in particular the tempering may be performed in two steps. The heat treatment following the natural aging is performed in two steps, wherein a second heat treatment between 12 and 24 hours at 100° C. to 200° C. is performed after the aforementioned first heat post-treatment for 5 to 15 hours at 70° C. to 120° C.

According to another advantageous feature of the present invention, only tempering may be performed, wherein a first step is performed starting at room temperature for 5 to 15 hours between 70° C. to 120° C., and thereafter a second step for 12 to 24 hours at 100° C. to 200° C.

According to an advantageous feature of the present invention, the method according to the invention may be used with metal sheets having a sheet thickness between 0.1 and 15 mm, preferably between 0.5 and 10 mm. In this way, the various heat treatment steps fully penetrate the employed material, thus adjusting a fully homogeneous desired structure.

According to an advantageous feature of the present invention, an aluminum alloy is used, wherein the aluminum alloy may have at least the following alloy elements, expressed in weight-percent;

| | | |
|---|---|---|
| Zinc | (Zn) | [%]: 2 to 8% |
| Magnesium | (Mg) | [%]: 0.3 to 5.5%. |
| Chromium | (Cr) | [%]: 0.05 to 1%. |
| Zirconium | (Zr) | [%]: 0.04 to 0.5% |
| Copper | (Cu) | [%]: ≤4.5% |
| Manganese | (Mn) | [%]: ≤1.0%. |
| Iron | (Fe) | [%]: ≤0.8% |
| Silicon | (Si) | [%]: ≤0.7% |
| Titanium | (Ti) | [%]: ≤0.5% |
| Zirconium + Titanium | (Zr + Ti) | [%]: 0.04 to 0.5% |
| Aluminum | (Al) | [%]: remainder. |

A structural sheet metal component for a motor vehicle can be produced with the method of the invention, wherein the sheet metal component with excellent design degrees of freedom and simultaneously high strength values is produced from a hardenable aluminum alloy.

Advantageously, with the method according to the invention, components may be produced having a tensile strength of at least 300 MPa and a yield strength of at least 250 MPa at an elongation at break of at least 12%; preferably, a yield strength of more than 300 MPa at an elongation at break of more than 14% may be attained.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
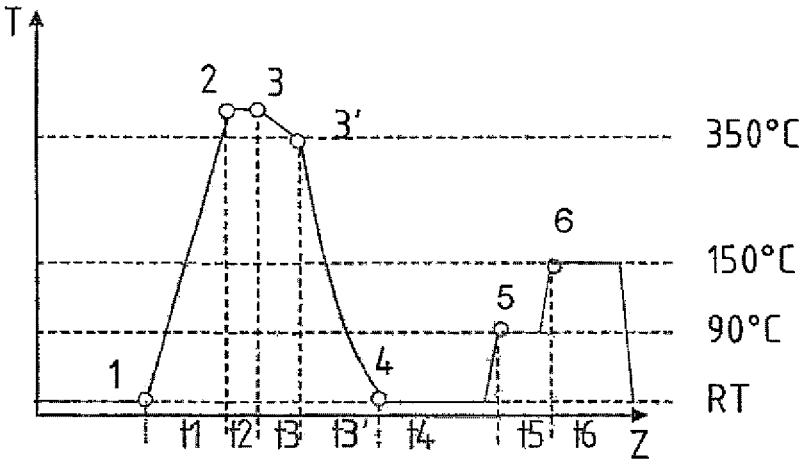
FIG. 1 a time-temperature diagram of the method according to the present invention with two-step heat post-treatment.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a time-temperature diagram of a forming process performed according to the invention which includes natural aging and a two-step heat post-treatment. The temperature is indicated on the ordinate and the time Z on the abscissa. A duration t1 of maximally 60 minutes is indicated after the heating start 1. Thereafter, the transfer into the forming tool 2 commences, wherein the temperature decreases only slightly during a short time t2 between the start transfer 2 and the forming start 3. When the forming process is terminated, indicated by its the forming end 3', the formed component is cooled. Cooling is preferably actively performed for a duration t3', so that the natural aging start 4 can begin at about room temperature RT. Natural aging is then performed in the component for a duration t4. After natural aging has be performed for a certain duration t4 at room temperature RT, a multistep heat post-treatment follows, wherein first tempering 5 is performed in a first step, with the temperature of the first step held constant for a duration t5. Thereafter, the temperature is increased to the second stage 6 and again held constant for a duration t6. Thereafter, a cooldown to room temperature RT is performed. The cooldown can be active and/or passive.

Figure 2:
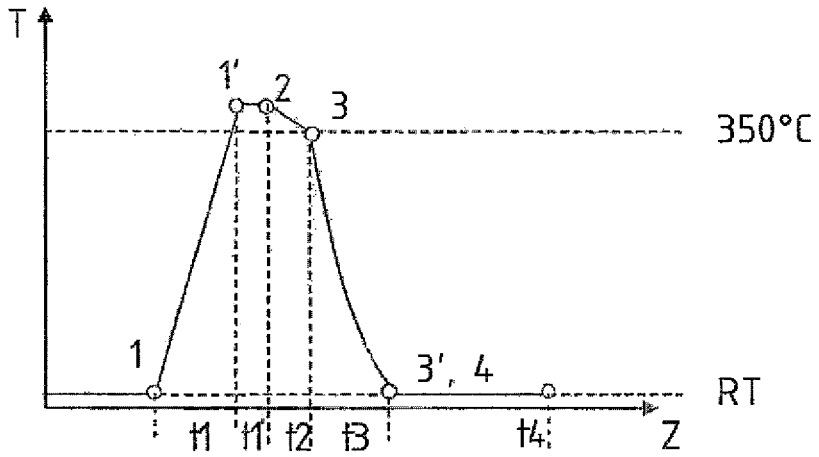
FIG. 2 a time-temperature diagram of the method according to the present invention with heat post-treatment at room temperature.

FIG. 2 shows a time-temperature diagram of another embodiment of the method according to the invention. The sheet metal blank is hereby heated at a heating start 1 to a heating temperature for a duration t1 of maximally 60 minutes. When the heating temperature is reached, the temperature is held substantially constant during a holding time t1', followed by the transfer into a forming tool 2, wherein temperature decreases only slightly during the transfer time t2. Forming then begins, wherein rapid cooldown or a cooldown in air to room temperature RT occurs during the time t3 when forming 3' ends. Thereafter, natural aging 4 takes place.

Figure 3:
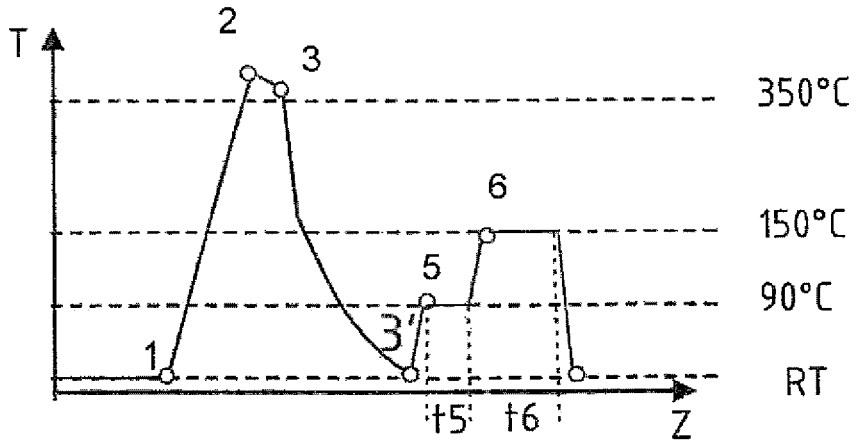
FIG. 3 a time-temperature diagram of the method according to the present invention with two-step heat post-treatment without natural aging.

FIG. 3 shows another embodiment of the present invention, wherein the sheet metal blank is again heated from a heating start 1 to a heating temperature and transferred to a forming tool 2 when the heating temperature is reached. Thereafter, forming takes place, wherein cooldown takes place between the forming start 3 and the forming end 3' depending on the tool temperature. With the present tool, cooling takes place almost to room temperature RT. Thereafter, a heat-up takes place to a first step for tempering 5. The heating step is held for a duration t5, whereafter heating to a second step takes place for tempering 6, which is again held for a time of the second stage t6. Thereafter, cooldown to room temperature RT or quenching is again performed.

Figure 4:
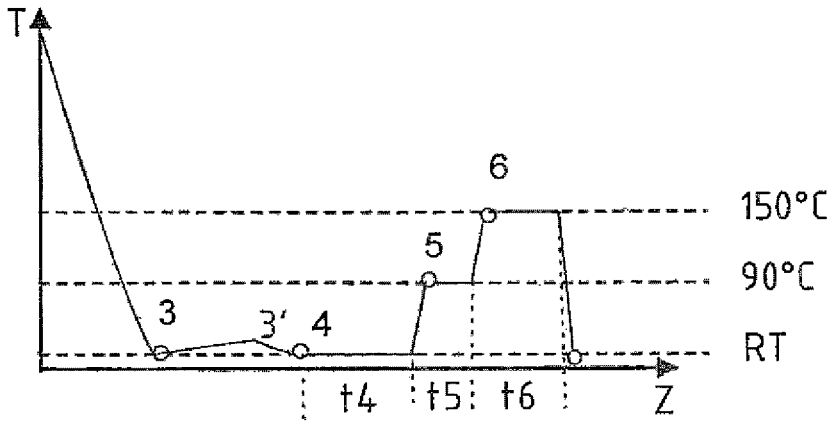
FIG. 4 a time-temperature diagram of the method according to the present invention, wherein natural aging is performed at room temperature and heat post-treatment is performed in two steps.

FIG. 4 shows a fourth embodiment of the method according to the invention, wherein the sheet metal blank is formed at room temperature RT after being heated to a heating temperature and subsequently cooled. A marginal temperature increase caused by forming is observed between the forming start 3 and to forming end 3'. After termination of the forming, natural aging 4 begins, which is held for a duration t4. Heating to a first step for tempering 5 follows the natural aging, wherein after reaching a first temperature for tempering for a duration t5, the first step of tempering is held constant. Thereafter, heating takes place to a second stage for tempering 6, wherein the second temperature for tempering is once more held constant for a duration t6. When the second stage of tempering is terminated, cooling or quenching to room temperature RT takes place.

Figure 5:
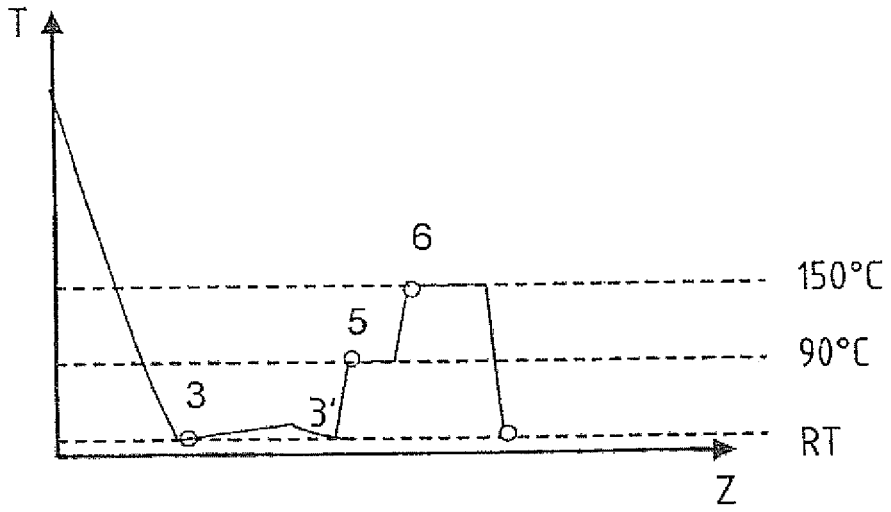
FIG. 5 a time-temperature diagram according to FIG. 4, however without natural aging.

FIG. 5 shows a fifth embodiment of the method according to the invention which is configured similar to FIG. 4; however, natural aging after termination of forming 3' is eliminated and tempering takes place.

Figure 6:
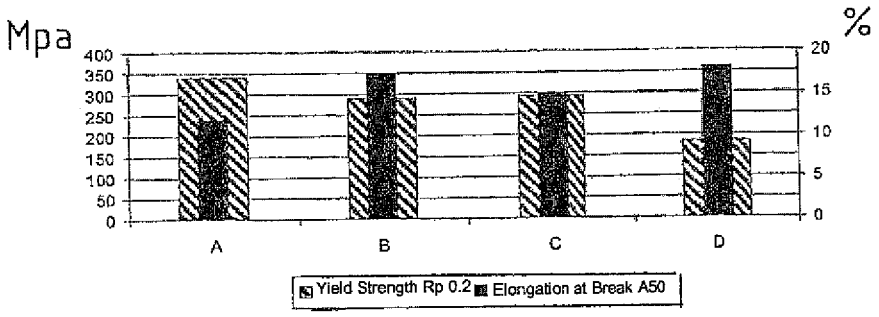
FIG. 6 a diagram with a comparison of the strength values.

FIG. 6 compares the attained mechanical strength characteristics of different aluminum alloys. The yield strength is illustrated on the left scale in mega-Pascal and the elongation at break A50 on the right scale in percent. Compared are sheet metal blanks in the states T6 (A) and T4 (B), each showing a corresponding yield strength and elongation at break. A blank (C) after termination of the method of the invention according to FIG. 1 and a blank (D) which was only naturally aged for 4 weeks are shown on the opposite side of FIG. 6. As can be seen, the yield strength is approximately identical to the initial states T6 (A) or T4 (B) when the method of the invention is used. Compared to a four-week natural aging process (D) the yield strength exceeds almost 3 times the adjusted yield strength. Conversely, the elongation at break is held at a favorable level between the state T6 (A) and T4 (B) for a component produced with the method according to the invention.

Figure 7:
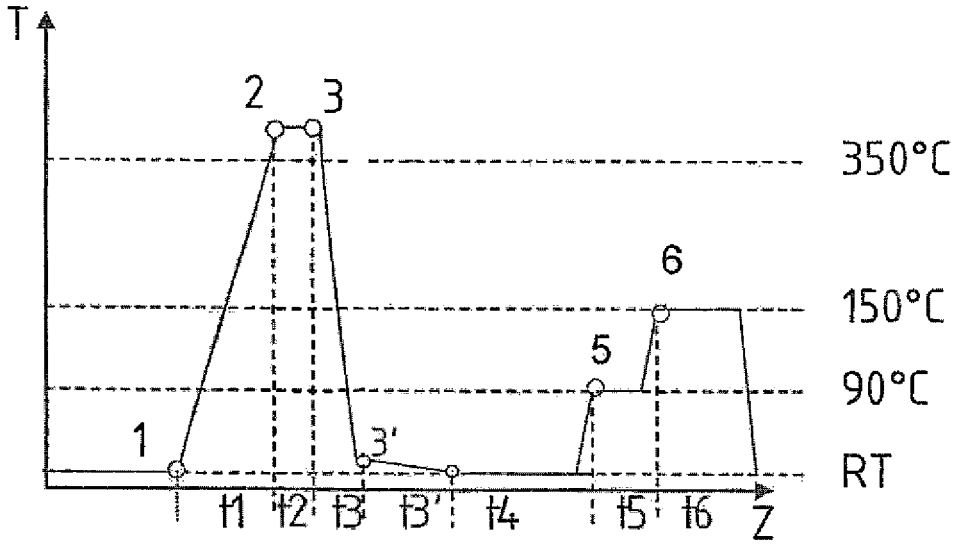
FIG. 7 a time-temperature diagram of the method according to the present invention with heat post-treatment.

FIG. 7 shows a time-temperature diagram of a forming process performed according to the invention with natural aging and a two-step heat post-treatment. The temperature T is here indicated on the ordinate and the time Z on the abscissa. A duration t1 of maximally 60 minutes is indicated following the heating start 1. Thereafter, the transfer into the forming tool 2 starts, wherein only a small decrease in temperature is observed during the short time t2 between the start transfer 2 and the forming start 3. The workpiece is then cooled down from the forming start 3 to the forming end 3' in the forming tool itself, so that the workpiece has a temperature at the forming end 3' which is substantially at room temperature RT or essentially only slightly above room temperature RT. Thereafter, the component is held at room temperature RT or cooled to room temperature RT from the temperature slightly above room temperature RT, which takes place during the time t3' between the forming end and the natural aging start. Thereafter, natural aging 4 begins at room temperature RT, wherein natural aging is held for a duration t4. When the natural aging is performed for a specified time interval t4 at room temperature RT, tempering is first performed in a multistep heat post-treatment in a first step 5, with the temperature of the first step held constant for a duration t5. Thereafter, the temperature is increased to the second step 6 and again held constant for a duration t6. Thereafter, cooldown to room temperature RT takes place during a cooling time. The cooldown can here be active and/or passive.

Figure 8:
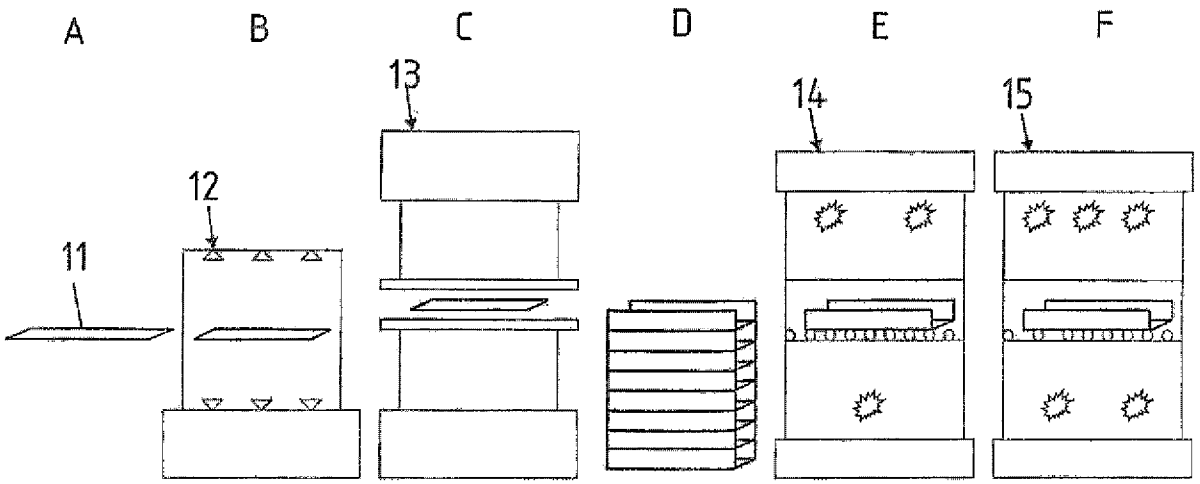
FIG. 8 a process flow according to the present invention.

FIG. 8 shows the application of the method according to the invention in a forming line, wherein first a blank 11 in form of a hardenable light metal blank in the state T4, T5, T6 or T7 is provided at the position A. Thereafter, the blank is heated in a heating device 12, where heating can be performed according to the invention for example conductively, inductively or with other heating methods mentioned in the context of the invention. The heating device 12 is located at the position B. In a preferred embodiment, heating takes place within less than 10 minutes, in particular less than 1 minute. The component is subsequently transferred directly to the forming tool. If the heating temperature is held, it is preferably held for less than 3 minutes. In a particularly preferred embodiment of the method of the invention, the blank is heated for a duration of less than 15 seconds and held at the heating temperature for a duration of less than 5 minutes before being transferred to the forming tool.

Thereafter, another transfer to a forming station 13 takes place, which is illustrated at the position C in FIG. 8. Preferably, the forming tool of the forming station 13 is not temperature-controlled, so that it is essentially at room temperature RT. The heated blank 11 is hereby quenched during forming. Preferably, the forming tool can also be actively cooled, so that the heated blank 11 is initially only slightly cooled down during forming and subsequently quenched by the active cooling.

The workpiece is then removed from the forming tool at the position C and transported to the position D. This corresponds to storage at room temperature RT, so that the formed sheet metal blanks can be naturally aged. This is preferably done at room temperature RT, in particular for duration of about 80 hours. The component is then transferred from the storage position D to the position E. The position E includes a first oven 14 in which an active aging process is performed, in particular in the illustrated example at about 90° C. for a duration of 10 hours. Following the first oven 14 at the position E, the workpiece is transferred to a second oven 15 in the region of the position F, where a second tempering step at a particularly preferred temperature of about 150° C. takes place for a particularly preferred duration of 18 hours. The first and the second oven 14, 16 may also be a dual-zone oven through which the component passes for the duration of the tempering. The illustration of the method according to the invention of FIG. 8 can also be used at the different positions in conjunction with all other process variants and durations and temperature ranges according to the present invention.

The process variants described above with reference to the figures, in particular the process variants illustrated in FIGS. 7 and/or 8, can be used to adjust the strength characteristics in the component commensurate with the column C in FIG. 6. The strength characteristics relate particularly to a range of the tensile strength of at least 280 MPa to 500 MPa, preferably of at least 300 MPa to 450 MPa. Moreover, the components have a yield strength of at least 230 MPa to 500 MPa, preferably of at least 250 MPa to 450 MPa.

In addition, the components have an elongation at break of at least 12%. Particularly preferred, a yield strength of more than 300 MPa at an elongation at break of more than 14% is attained. The aforementioned values have limit values of 500 MPa and 20%.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A method for producing a structural sheet metal component made from an aluminum alloy for a motor vehicle, comprising the steps of:

providing an aluminum sheet blank in a state T4 or T5 or T6 or T7, prior to forming the aluminum sheet blank, heating the aluminum sheet blank in an unformed state thereof to a heating temperature between 350° C. and 450° C. and below solution heat treatment temperature of the aluminum sheet blank, forming the aluminum sheet blank to a structural sheet metal component at said heating temperature, and heat post-treatment of the formed structural sheet metal component, wherein in the heat post treatment the formed structural sheet blank is naturally aged at room temperature for less than 251 hours, followed by a heat post-treatment at 70° C. to 120° C. for 5 to 15 hours, said heat post-treatment excluding solution heat treatment of the formed structural part, wherein T4, T5, T6 and T7 refer to heat-treated states of an aluminum alloy according to DIN EN 515, with T4 referring to an aluminum sheet metal blank that is solution-annealed and naturally aged; T5 to an aluminum sheet metal blank that is quenched from a hot-forming temperature and tempered; T6 to a sheet metal blank that is solution-annealed and tempered; and T7 to a sheet metal blank that is solution-annealed and over-aged.

2. The method of claim 1, wherein the aluminum sheet blank is heated to the heating temperature in less than 60 minutes.

3. The method of claim 1, wherein the aluminum sheet blank is heated to the heating temperature in less than 30 minutes.

4. The method of claim 1, wherein the aluminum sheet blank is heated to the heating temperature in less than 10 minutes.

5. The method of claim 1, wherein the aluminum sheet blank is heated by at least one process selected from conduction, convection, resistance, induction, heat radiation and heat conduction.

6. The method of claim 1, wherein the aluminum sheet blank is formed following heating without active cooling.

7. The method of claim 1, wherein the aluminum sheet blank is formed in a heated forming tool.

8. The method of claim 1, wherein the aluminum sheet blank heated to the heating temperature is passively cooled at room temperature RT with ambient air or actively cooled, wherein the aluminum sheet blank is actively cooled through contact with a medium.

9. The method of claim 8, wherein the aluminum sheet blank is actively cooled by quenching at a cooling speed of greater than 100° C./s.

10. The method of claim 8, wherein the aluminum sheet blank is actively cooled by quenching at a cooling speed of greater than 250° C./s.

11. The method of claim 8, wherein the aluminum sheet blank is actively cooled by quenching at a cooling speed of greater than 400° C./s.

12. The method of claim 8, wherein the aluminum sheet blank is actively cooled with water.

13. The method of claim 1, wherein after forming, precipitation hardening is performed at room temperature.

14. The method of claim 1, wherein the heat post-treatment is performed in two steps, wherein after a first heat post-treatment step a second heat post-treatment is performed for between 12 and 24 hours at 100° C. to 200° C.

15. The method of claim 1, wherein sheet metal blank has a thickness between the 0.1 and 15 mm.

16. The method of claim 1, wherein sheet metal blank has a thickness from 0.5 to 10 mm.

17. The method of claim 1, wherein the aluminum alloy is a precipitation-hardenable aluminum alloy, comprising at least the following alloy elements, expressed in weight-percent:

| | | |
|---|---|---|
| Zinc | (Zn) | [%]: 2 to 8% |
| Magnesium | (Mg) | [%]: 0.3 to 5.5%, |
| Chromium | (Cr) | [%]: 0.05 to 1%, |
| Zirconium | (Zr) | [%]: 0.04 to 0.5% |
| Copper | (Cu) | [%]: ≤4.5% |
| Manganese | (Mn) | [%]: ≤1.0%, |
| Iron | (Fe) | [%]: ≤0.8% |
| Silicon | (Si) | [%]: ≤0.7% |
| Titanium | (Ti) | [%]: ≤0.5% |
| Zirconium + Titanium | (Zr + Ti) | [%]: 0.04 to 0.5% |
| Aluminum | (Al) | [%]: remainder. |

18. A method of claim 1, further comprising cooling the sheet blank after the forming.

19. A method for producing a structural sheet metal component made from an aluminum alloy for a motor vehicle, comprising the steps of:

providing an aluminum sheet blank in a state T4 or T5 or T6 or T7, heating the aluminum sheet blank to a heating temperature between between 350° C. and 450° C., forming the aluminum sheet blank to a structural sheet metal component at said heating temperature, and heat post-treatment of the formed structural sheet metal component, wherein the heat post-treatment is performed in two steps, with a first step being performed for 5 to 15 hours between 70° C. and 120° C. and a following second step being performed for 12 to 24 hours at 100° C. to 200° C., wherein T4, T5, T6 and T7 refer to heat-treated states of an aluminum alloy according to DIN EN 515, with T4 referring to an aluminum sheet metal blank that is solution-annealed and naturally aged; T5 to an aluminum sheet metal blank that is quenched from a hot-forming temperature and tempered; T6 to a sheet metal blank that is solution-annealed and tempered; and T7 to a sheet metal blank that is solution-annealed and over-aged.

20. A method of claim 19, further comprising cooling the sheet blank after the forming.

* * * * *